US007181771B1

(12) United States Patent
Naehu

(10) Patent No.: US 7,181,771 B1
(45) Date of Patent: Feb. 27, 2007

(54) CHILD PROTECTIVE GARMENT

(76) Inventor: Janice Naehu, 10960 Ashton Ave., #202, Los Angeles, CA (US) 90024

( * ) Notice: Subject to any disclaimer, the term of this patent is extended or adjusted under 35 U.S.C. 154(b) by 0 days.

(21) Appl. No.: 11/321,981

(22) Filed: Dec. 28, 2005

Related U.S. Application Data

(60) Provisional application No. 60/650,696, filed on Feb. 7, 2005.

(51) Int. Cl.
*A41B 13/10* (2006.01)

(52) U.S. Cl. ..... 2/49.1; 2/48

(58) Field of Classification Search ..... 2/46, 2/48, 49.1, 49.2, 49.3, 49.4, 49.5, 51, 114, 2/111, 72, 80, 83, 50, 52, 47, 75, 79, 69; D2/720, D2/860, 861, 714
See application file for complete search history.

(56) References Cited

U.S. PATENT DOCUMENTS

| | | | | | |
|---|---|---|---|---|---|
| 717,854 | A | * | 1/1903 | Hoston | 2/51 |
| 1,018,078 | A | * | 2/1912 | Potter | 2/51 |
| 1,424,013 | A | | 7/1922 | Hale | |
| 2,446,689 | A | | 8/1948 | Brose et al. | |
| 2,635,245 | A | * | 4/1953 | Nigro | 2/80 |
| 2,722,685 | A | * | 11/1955 | Lucas | 2/48 |
| 3,144,659 | A | * | 8/1964 | Matthews | 2/83 |
| 4,266,299 | A | * | 5/1981 | Beal | 2/46 |
| 4,304,006 | A | * | 12/1981 | Swart | 2/49.1 |
| 4,569,086 | A | * | 2/1986 | Takefman | 2/49.2 |
| 4,601,065 | A | * | 7/1986 | Sigl et al. | 2/49.2 |
| 4,649,572 | A | * | 3/1987 | Roessler | 2/49.2 |
| 4,660,224 | A | | 4/1987 | Ashcraft | |
| 4,733,411 | A | * | 3/1988 | Foti | 2/49.1 |
| 5,150,477 | A | * | 9/1992 | Elberson et al. | 2/114 |
| D402,087 | S | | 12/1998 | Scherich | |
| 5,956,763 | A | | 9/1999 | Blackshear | |
| 6,243,869 | B1 | | 6/2001 | Ekovich | |
| D458,436 | S | | 6/2002 | Santillana | |
| 6,408,439 | B1 | | 6/2002 | Garforth-Crippen | |
| 2001/0047532 | A1 | * | 12/2001 | Marrero | 2/49.1 |
| 2006/0021106 | A1 | * | 2/2006 | Snodgrass | 2/48 |

* cited by examiner

*Primary Examiner*—Amy B. Vanatta
(74) *Attorney, Agent, or Firm*—Richard S. Erbe

(57) ABSTRACT

A garment designed to protect the clothing of a child from food and drink spills while a child is eating is constructed generally by two pieces, a back flap and a lower piece. The back flap covers the upper back and shoulders of the child wearing the garment and provides a counterbalance to the lower piece, which covers the arms, body, and most of the legs of the child. The back flap and lower piece, when joined together, form an opening for a child's head and a side closure for securing the garment to the child. The arm, body, and leg portions of the lower piece are specifically shaped to provide optimal protection to the child's clothing, while also allowing relatively free movement of the child's arms. The garment is also designed so that it may be worn by a child sitting in a conventional high chair.

6 Claims, 3 Drawing Sheets

FIG. #1
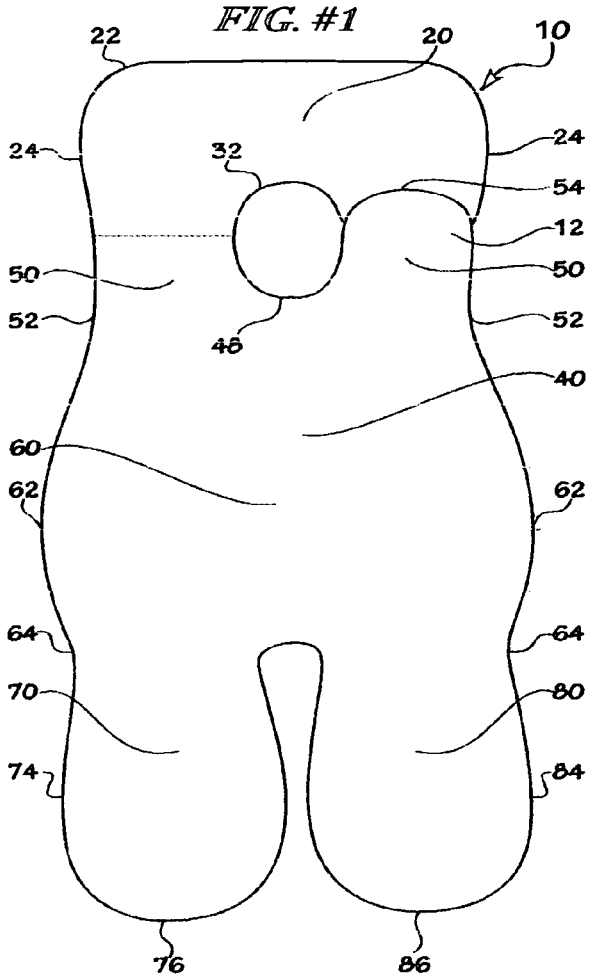
FIG. #2
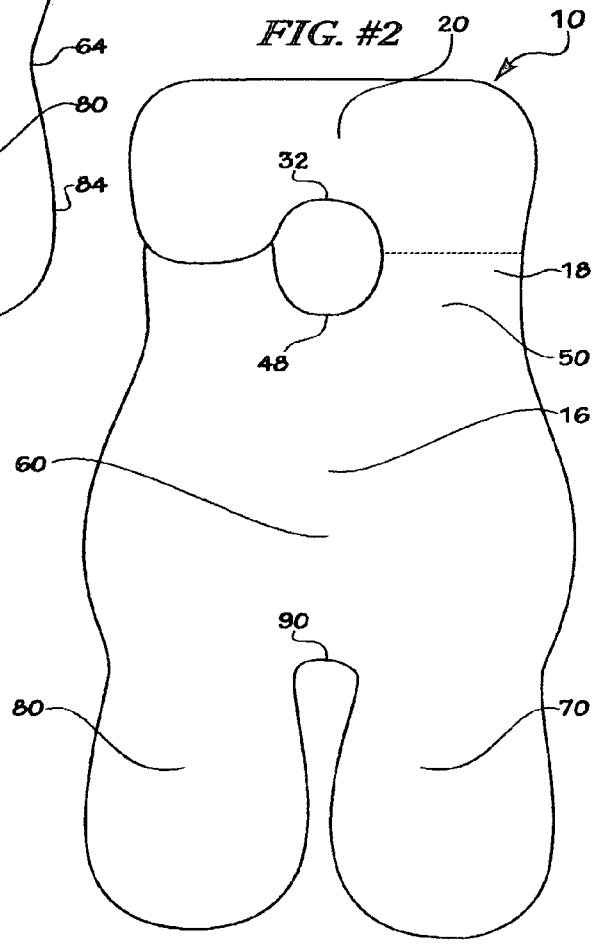

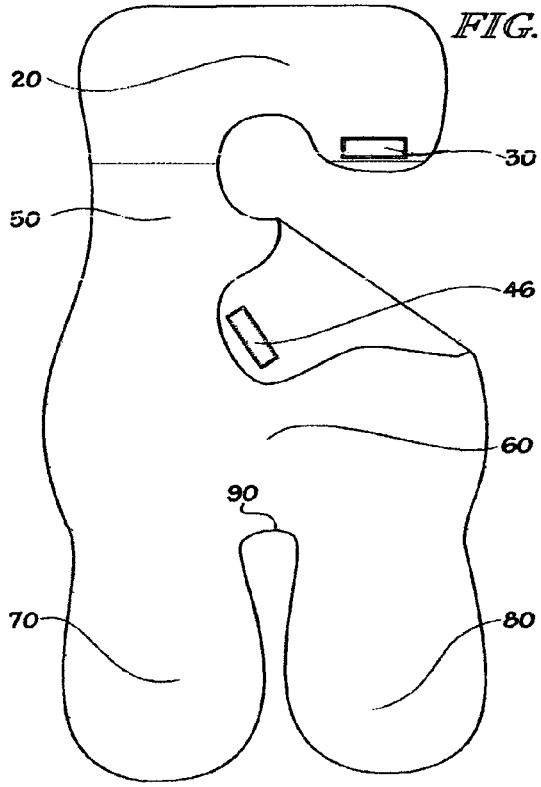
FIG. #3
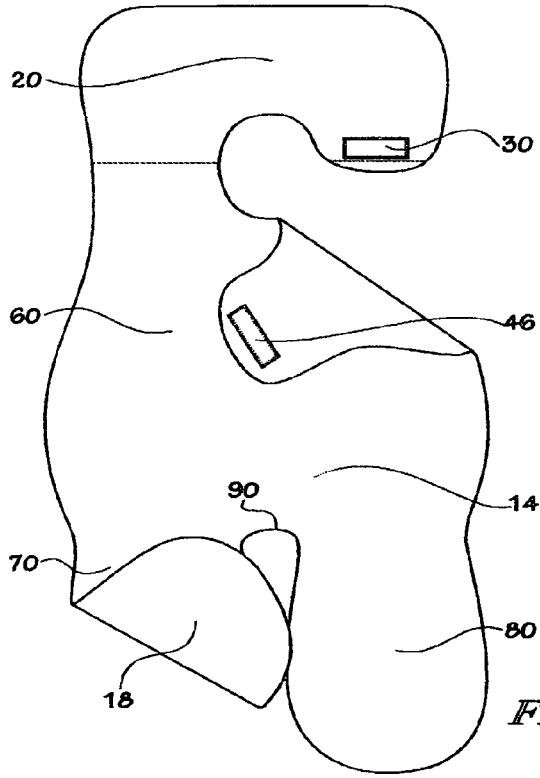
FIG. #4
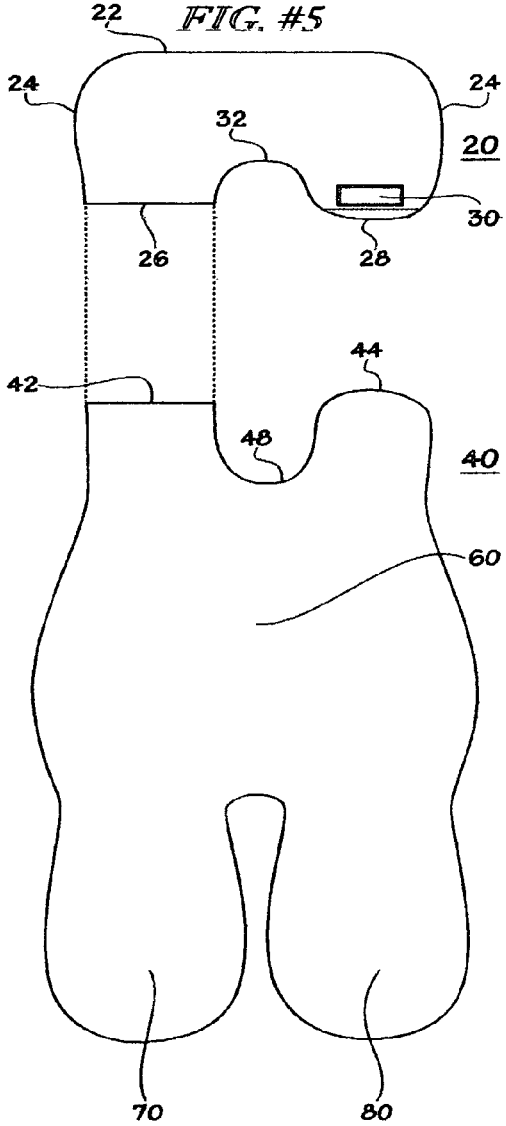
FIG. #5

FIG. #6
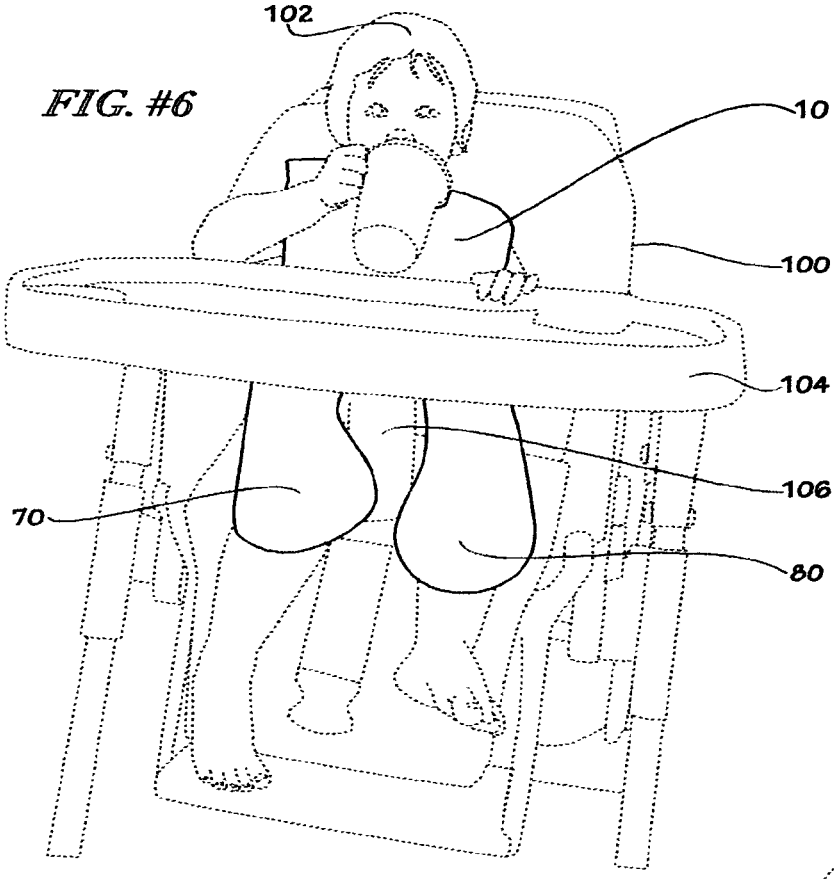
FIG. #7
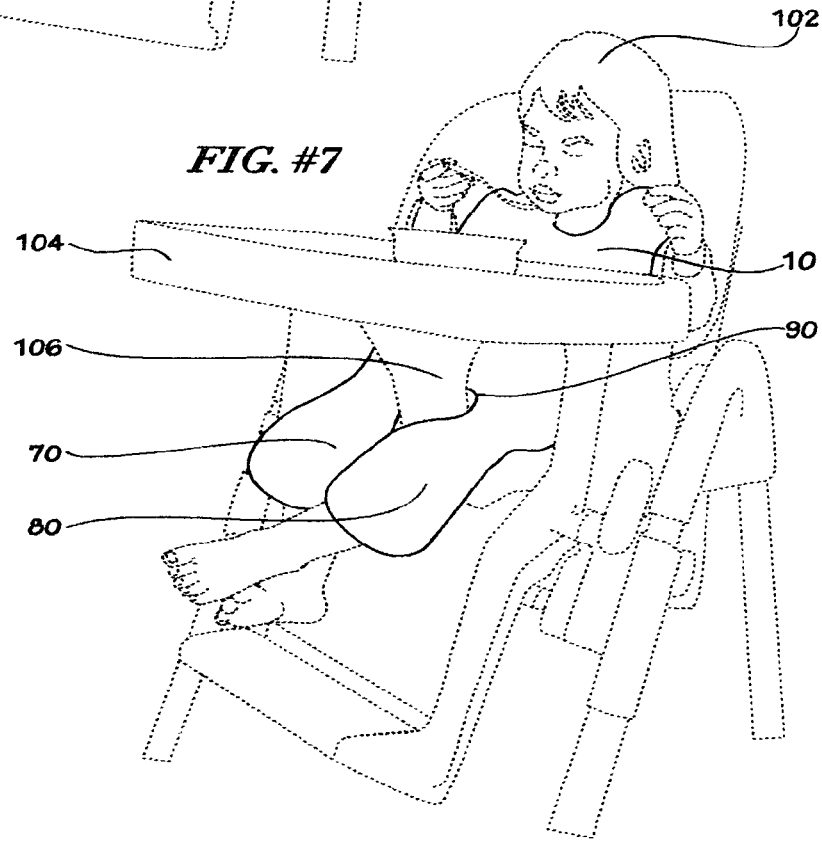

CHILD PROTECTIVE GARMENT

RELATED APPLICATIONS

This application claims the benefit of U.S. Provisional Application for Patent No. 60/650,696, filed Feb. 7, 2005, incorporated herein by reference.

BACKGROUND OF THE INVENTION

1. Field of the Invention

The present invention relates to children's clothing. More particularly, it relates to a garment worn by a child while the child is eating, and one that has particular utility when the child is seated in a high chair.

2. General Background and State of the Art

Feeding a small child can be a messy and frustrating experience, both for the person feeding the child and for the child. Food tends to wind up everywhere, with some small amount actually winding up in the child. Clothing, furniture, floors and walls all frequently need cleaning up after a small child has eaten a meal, not to mention the child itself.

Children learn to feed themselves while sitting in a high chair by using their fingers or with a utensil for the very first time. Using a utensil requires coordination and dexterity that are not yet fully developed in young children. As a result, most food ends up on the child's clothing.

Various forms of protection of a child's clothing have been developed to protect the child's clothing from food spills commonly occurring during feeding. Paper napkins and small neck bibs are common. Less commonly known are garments that cover more than just the upper part of a child's body. There are protective garments for covering children's clothing during feeding that may cover the trunk, waist and part or all of the legs of the child.

There are a variety of problems associated with known protective garments for putting on a child while the child is feeding. One problem is the method of securing the garment to the child. Many commonly known garments have an opening that must be fit over the child's head. Some garments have straps that must be tied around the child's neck. With either of these types of garments, securing the garment around the child's neck requires some maneuvering of the child's head and discomfort to the child, which may lead to some unpleasantness for the person trying to feed the child.

Another problem associated with protective garments used to protect a child's clothing during feeding is that while they may cover portions of the clothing of the child, they may restrict the child's ability to move parts of the body, for example, the arms, which can cause discomfort to the child and restricts the ability of the child to learn how to feed itself.

Other known garments of the type that are used to protect the clothing of a child during feeding may include elastic or other types of straps to secure to the child in the child's body or the legs. These straps can frequently be difficult to position correctly, especially if the child is restless. After the child has been fed, removal of a garment having leg straps may become a chore, as food can smear all over the child, the floor and the chair while a person literally wrestles with the child to remove the leg straps.

Another problem with known garments that are used to protect the clothing a child during feeding is that while some are designed to cover more than just the chest of the child, they are not easily adapted for use when the child is seated in a high chair. Most conventional high chairs have a tray supported by a tray bar, which the child seated in the high chair must straddle, with one leg on one side of the tray bar and the other leg on the other side of the tray bar. This may cause the protective garment to be skewed or bunched up and lose its effectiveness.

Most known child protective garments used to protect the child's clothes during feeding are constructed of plastic or oil cloth materials that must be wiped down or rinsed after use. A problem with such garments is that if they are not thoroughly wiped or disinfected after use, residual food can be pushed into the seams and potentially harbor harmful bacteria.

Another problem associated with known garments that are used to protect the clothing a child during feeding is that children tend to turn their heads and wipe their mouths on their shoulders while feeding. This tendency is most pronounced when a child's hands are full of food or holding a utensil. Most known garments do not cover the shoulder area.

Yet another problem associated with known garments that are used to protect the clothing a child during feeding is that they do not cover the areas (the upper thighs) where most food tends to fall when a child is feeding while sitting in a high chair.

There exists, therefore, a need for a protective garment for a child that can be easily and comfortably secured around a child's neck.

There also exists a need for a protective garment for a child that protects the clothing on the upper body during feeding, yet allows the child relatively free movement of his or her arms, so that the child may more readily learn to feed itself.

There also exists a need for a protective garment that can be worn by a child while child is eating that is optimally shaped to provide protection to clothing on various parts of the body, whether it be the arms, torso or legs of the child, without having to further secure the garment to the child.

There also is a need for a protective garment that can be worn by a child while the child is eating that is designed to be worn by the child sitting in a high chair without requiring adjustment of the garment to account for the high chair tray or for the tray support bar.

There is also a need for a protective garment that can be worn while a child is eating that can be easily removed from the child while minimizing the amount of spillage of food that has fallen on the garment.

There further exists a need for a protective garment that can be worn while a child is eating that can be easily sanitized to protect the child from potentially dangerous bacteria.

SUMMARY OF THE INVENTION

Accordingly, it is an object of the invention to provide a protective garment for wearing by a child during eating that is easy to secure to and remove from the child without having to maneuver head or other parts of the child.

An additional object of the invention to provide a protective garment for a child that is designed to be worn by a child sitting in a high chair.

A further object of the invention is to provide a protective garment for a child that is configured to allow the child relatively free movement of the arms.

Yet another object of the invention to provide a protective garment for a child that is configured to provide optimal protection for various areas of the body, such as the arms, trunk, and legs.

Another object of the invention is to provide a protective garment for a child that is aesthetically pleasing to the eye.

Another object of the invention is to provide a protective garment for a child that is easily cleanable to protect the child from germs.

Still another object of the invention is to provide a protective garment for a child that can be removed from the child with a minimum of effort while preventing further spillage of food.

A further object of the invention is to provide a protective garment for a child that covers those areas where food is most likely to be spilled or wiped off by the child.

These and other objectives are achieved by the present invention, which, in a broad aspect, provides the user with a protective garment that can be secured to a child to protect the child's clothing from spills while the child is eating. The garment according to the present invention is designed not only so that parents may assist in feeding, but is also designed for parents to encourage children to master their feeding skills while providing confidence to the parent that the child's clothing will be protected. The garment is configured to be secured around the neck of the child with a side closure, and without using any straps, which does not require the person putting the garment on the child to maneuver the child's head and neck or otherwise manipulate the child's body.

The protective garment of the present invention is generally made from two distinctive pieces that are sewn together and form an opening for fitting around the neck of the child. The first piece, called the back flap, provides counterbalance weight to the rest of the garment covering much of the front portion of the child. It also provides coverage in the shoulder area of the child to protect clothing where children tend to wipe their mouths while feeding. The second, or lower piece provides distinctively configured portions designed for optimal coverage of the arms, body, and part of the legs. The arm portion not only protects the clothing near the arms but also is also designed to provide relatively free movement of the child's arms so that the child may more readily learn how to feed itself.

The back flap and lower piece both have a connected end and an open end, in between which is a curved opening. The connected ends of the back flap and lower piece are permanently sewn together, while the open ends may be opened and closed to secure the garment to the child. The open ends each have an attaching means so that the open ends may be closed together when appropriate. In the preferred embodiment of the invention, the attaching means is a hook and loop configuration, such as Velcro®, although buttons, snaps or other known means may be used. The attaching means are designed to form a side closure, which usually minimizes any required maneuvering of the child in order to secure the garment to the child. Straps, which are the most commonly used method for securing known protective garments to a child, are avoided, as straps require the child's head to be pushed forward to tie the straps together in the back, which can be uncomfortable and disconcerting to a child.

The lower piece has been configured in such a way as to maximize protection of the child's clothing, while allowing the child relatively free movement of the arms and also allows the child to wear the garment while seated in a conventional high chair without requiring adjustment of the garment. The garment of the present invention does not become "bunched up" and lose protection area when the child is seated in a high chair.

The arm portions of the lower piece are generally formed by inwardly curving the lower piece from the connected and open ends for that part of the garment protecting the arms. Below the arm portion is the body portion, where the lower piece of the garment curves outwardly to provide coverage to the chest and stomach area to optimize coverage while not restricting movement of the child's arms. The curves are rounded for easy sewing of the fabric to the liner and are also designed to be aesthetically pleasing. The garment is made up generally of gentle curves, with the only straight edges being where the back flap and the lower piece are joined.

Below the body portion of the lower piece, are the first and second leg portions. In transition between the body portion and the leg portions, the garment first narrows and then flares out on both sides near the top of the thighs to provide optimal coverage and also to allow for a child to be placed in a high chair without having to manipulate or adjust the protective garment. The space between the first and second leg portions of the garment is specifically designed to fit around the tray bar support of conventional high chairs. Such a garment could also be used in conjunction with wooden high chairs frequently found in restaurants. Known protective garments either stop short of the child's legs or are not designed for use by a child sitting in a high chair. Children sitting in a high chair tend to drop food on their upper thighs. The garment according to the present invention is designed to cover this area of a child's clothing.

The garment of the present invention is preferably constructed with a washable fabric for the front of the garment sewn to a water repellent or waterproof lining.

The garment of the present invention may be sewn in a variety of ways, including being turned inside out or edge binding.

The fabric materials may include cotton, terry, flannel, polyester/cotton blends and the like. Alternatively, the garment according to the present invention may be made of paper or other disposable material for a single use, such as in a restaurant, for example.

After the child finishes feeding, the garment according to the present invention may be rolled up to prevent further spillage of food. The garment may then be washed and rolled up for storage or transport to another location.

Further objects and advantages of this invention will become more apparent from the following description of the preferred embodiment, which, taken in conjunction with the accompanying drawings, will illustrate, by way of example, the principles of the invention.

BRIEF DESCRIPTION OF THE DRAWINGS

The foregoing and other objects, aspects aid advantages will be better understood from the following detailed description of the preferred embodiment of the invention with reference to the drawings in which:

FIG. 1 illustrates a front view of an exemplary garment according to the present invention with the open ends closed;

FIG. 2 illustrates rear view of an exemplary garment according to the present invention with the open ends closed;

FIG. 3 illustrates a front view of an exemplary garment according to the present invention with the open ends unattached;

FIG. 4 illustrates a front view of an exemplary garment according to the present invention with the open ends unattached and one of the leg portions partially folded up;

FIG. 5 illustrates an exploded front view of an exemplary garment according to the present invention;

FIG. 6 illustrates a front view of a child sitting in a high chair while wearing an exemplary garment according to the present invention; and FIG. 7 illustrates a perspective view of a child sitting in a high chair while wearing an exemplary garment according to the present invention.

DETAILED DESCRIPTION OF THE PREFERRED EMBODIMENTS OF THE INVENTION

In the following description of the invention, reference is made to the accompanying drawings, which form a part thereof, and in which are shown, by way of illustration, exemplary embodiments illustrating the principles of the present invention and how it may be practiced. It is to be understood that other embodiments may be utilized to practice the present invention, and structural and functional changes may be made thereto without departing from the scope of the present invention.

The preferred embodiment of a garment according to the present invention is illustrated in FIGS. 1–5 and is generally referred to by the reference numeral 10. The garment is preferably constructed of a washable fabric 12 in front 14 sewn to a waterproof or water repellent liner 18 on the rear 16. Garment 10 includes back flap 20 and lower piece 40, which are shown as separated in FIG. 5. Back flap 20 provides counterbalance weight to the rest of garment 10, which covers much of the front portion of the child. Back flap 20 is also designed to cover the shoulder area of a child's clothing, as it has been found that a feeding child will frequently turn their head to wipe off their mouths in the shoulder area.

Back flap 20 includes back edge 22, sides 24, a connected end 26 and an open end 28. Connected end 26 is sewn to lower piece 40, to join back flap 20 and lower piece 40. Open end 28 also includes an attaching means 30, which could be hooks, buttons, snaps or a variety of known attaching means. In the preferred embodiment of the invention, attaching means 30 is of a hook and loop material, commonly known as Velcro. Curved opening 32 is formed between connected end 26 and open end 28 and allows garment 10 to be secured around the neck of a child to protect the child's clothing from food and drink that might get onto the clothes when the child is eating.

Lower piece 40 includes arm portions 50, body portion 60, first leg portion 70 and second leg portion 80. Each of arm portions 50, body portion 60 and leg portions 70 and 80 have been designed with specific curved shapes so as to provide full coverage of the child's clothing while allowing the child relatively free arm movement and adaptability to high chairs, as will be explained. It should be noted that arm portions 50 do not actually cover the child's arms.

Lower piece 40 includes connected flap 42 and open flap 44, between which is formed curved opening 48, which fits around the front of the neck of a child wearing garment 10 when open flap 44 is secured to open end 28 of back flap 20 by the juncture of closing means 46 and attaching means 30. This juncture forms a side closure 54, securing garment 10 to the child without having to manipulate the child's head as other types of closures require. Connected flap 42 is permanently sewn to connected end 26.

Arm portions 50 are formed by inwardly curved sides 52 and provide coverage of the child's upper body and arms while allowing the child relatively free movement of the arms.

In the area of the child's body below arm portions 50 is body portion 60. Here, garment 10 widens out over the stomach by rounded sides 62, which then provides optimal coverage for the child's clothing in that area. The design of rounded sides 62 not only provides an important utility but is also aesthetically pleasing to the eye and makes for easy sewing of the fabric 12 to the liner 18.

Below rounded sides 62, body portion 60 transitions inwardly at curved sides 64. From this point are formed first leg portion 70 and second leg portion 80, which cover the thighs, knees and part of the lower legs of the child. First leg portion 70 is formed by a pair of flared sides 74 connected by lower end 76. Second leg portion 80 is formed by a pair of flared sides 84 connected by lower end 86. The flared design of first leg portion 70 and second leg portion 80 provides optimal coverage for the clothing covering the legs of the child wearing garment 10.

Between first leg portion 70 and second leg portion 80 is an opening 90 that allows for the child wearing garment 10 to sit in a high chair without having to further adjust garment 10. This is an important feature of the present invention, as known protective garments do not have this feature.

FIGS. 6 and 7 show child 102 sitting in a high chair 100 while wearing garment 10. These views illustrate how opening 90 allows child 102 to straddle tray support bar 106, which supports tray 104. Most conventional high chairs are of a similar construction. The garment 10 of the present invention allows child 102 to sit in high chair 100 with first leg portion 70 and second leg portion 80 still in place and covering much of the legs of child 102. Opening 90 in garment 10 is provided so that the child 102 can easily sit in the illustrated position.

When the child has finished eating, garment 10 may be removed from the child by rolling up the garment, staring at lower ends 76 and 86. In this manner, much of the spilled food will remain on the garment without further spillage.

In an alternative embodiment of the invention, garment 10 may be made of a disposable material, such as paper, for single use applications, such as in a restaurant.

The foregoing description of the exemplary embodiment of the present invention has been presented for purposes of enablement, illustration, and description. It is not intended to be exhaustive of or to limit the present invention to the precise form discussed. There are, however, other configurations for child protective garments not specifically described herein, but with which the present invention is applicable. The present invention should therefore not be seen as limited to the particular embodiment described herein; rather, it should be understood that the present invention has wide applicability with respect to child protective garments. Such other configurations can be achieved by those skilled in the art in view of the description herein. Accordingly, the scope of the invention is defined by the following claims.

What is claimed is:

1. A garment for protecting the clothing of a child during feeding comprising:

a back flap having a back, sides, a connected end and an open end having an attachment means, a curved opening formed between said connected end and said open end configured to fit around the back of the neck of the child;

a lower piece disposed on the torso and legs and solely on the front of the child's body, said lower piece having a connected flap attached to said connected end, an open flap having a closing means for attaching to said attachment means, said lower piece further comprising:

an arm portion;

a body portion having rounded sides attached to the arm portion;

a pair of curved sides forming a transition connected to and extending from said rounded sides of the body portion; and first and second leg portions attached to said transition; and a curved opening formed between the connected flap and the open flap configured to fit around the front of the neck of the child.

2. The garment according to claim 1, wherein the sides of said arm portion are inwardly curved in relation to the sides of the back flap and the body portion, and do not cover any portions of the child's arms.

3. The garment according to claim 1, wherein said rounded sides of the body portion are outwardly rounded, whereby, the width of the body portion is maximized over the torso of the child and reduced in size where the arm portion connects to the body portion and where the transition connects to the body portion.

4. The garment according to claim 1, wherein each leg portion further comprises:

an outer flared side;

an inner flared side; and a lower end connecting the outer flared side and the inner flared side.

5. The garment according to claim 1, wherein said first and second leg portions cover the thighs and knees of the child.

6. The garment according to claim 5, further comprising an opening between said first leg portion and said second leg portion, said opening configured to allow the child wearing the garment to sit in a conventional high chair having a feeding tray secured to the high chair by a tray bar, so that the child's legs may straddle the tray bar and said opening is adjacent the tray bar, and the first and second leg portions are of sufficient length to cover the thighs and knees of the child without having to adjust the garment.

* * * * *